US012270149B1

(12) United States Patent
Qian et al.

(10) Patent No.: US 12,270,149 B1
(45) Date of Patent: Apr. 8, 2025

(54) RENEWABLE ANTIBACTERIAL WATERBORNE POLYURETHANE SYNTHETIC LEATHER WITH HIGH PEEL STRENGTH AND PREPARATION METHOD THEREOF

(71) Applicant: ZHEJIANG MEISHENG NEW MATERIAL CO., LTD, Shaoxing (CN)

(72) Inventors: Neng Qian, Shaoxing (CN); Guochun Qian, Shaoxing (CN); Aixue Dong, Shaoxing (CN); Weiming Wang, Shaoxing (CN); Gaofeng Xie, Shaoxing (CN); Haifeng Zhu, Shaoxing (CN)

(73) Assignee: ZHEJIANG MEISHENG NEW MATERIAL CO., LTD, Shaoxing (CN)

( * ) Notice: Subject to any disclaimer, the term of this patent is extended or adjusted under 35 U.S.C. 154(b) by 0 days.

(21) Appl. No.: 18/923,749

(22) Filed: Oct. 23, 2024

Related U.S. Application Data

(63) Continuation of application No. PCT/CN2024/104913, filed on Jul. 11, 2024.

(30) Foreign Application Priority Data

Jan. 25, 2024 (CN) ..... 202410103083.0

(51) Int. Cl.
*D06N 3/14* (2006.01)
*D06M 11/38* (2006.01)
(Continued)

(52) U.S. Cl.
CPC ..... *D06N 3/14* (2013.01); *D06M 11/38* (2013.01); *D06M 13/148* (2013.01);
(Continued)

(58) Field of Classification Search
CPC ..... D06N 3/14; D06N 2209/1671; D06N 2211/28; D06N 3/0059; D06N 3/0036; D06N 3/0009
See application file for complete search history.

(56) References Cited

FOREIGN PATENT DOCUMENTS

CA 3028474 A1 1/2020
CN 101701425 A 5/2010
(Continued)

OTHER PUBLICATIONS

Xiaofei Li, Preparation and application of water-based polyurethane adhesive for synthetic leather, Chinese Master's Theses Full-text Database Engineering Science and Technology I, 2016, pp. 20, 30-32, 37, No. 6.

(Continued)

*Primary Examiner* — Lawrence D Ferguson
(74) *Attorney, Agent, or Firm* — Bayramoglu Law Offices LLC

(57) ABSTRACT

A renewable antibacterial waterborne polyurethane synthetic leather with high peel strength and a preparation method thereof are disclosed. According to the disclosure, a renewable and durable antibacterial waterborne polyurethane emulsion is coated on release paper to obtain a polyurethane surface layer, and the polyurethane surface layer is adhered to the surface of a surface-modified base fabric to obtain a base fabric containing the polyurethane layer; and then chlorination is performed to obtain the renewable antibacterial waterborne polyurethane synthetic leather with high peel strength. The halamine antibacterial monomer used in the disclosure has antibacterial renewability and is connected with an ultraviolet absorbent, so that the antibacterial durability of a polyurethane coating is improved.

18 Claims, 3 Drawing Sheets

(51) Int. Cl.

| | |
|---|---|
| ***D06M 13/148*** | (2006.01) |
| ***D06M 13/463*** | (2006.01) |
| ***D06N 3/00*** | (2006.01) |
| *D06M 101/32* | (2006.01) |

(52) U.S. Cl.
CPC ..... *D06M 13/463* (2013.01); *D06N 3/0006* (2013.01); *D06N 3/0009* (2013.01); *D06N 3/0011* (2013.01); *D06N 3/0036* (2013.01); *D06N 3/0059* (2013.01); *D06N 3/0097* (2013.01); *D06M 2101/32* (2013.01); *D06N 2209/1664* (2013.01); *D06N 2209/1671* (2013.01); *D06N 2211/28* (2013.01)

(56) References Cited

FOREIGN PATENT DOCUMENTS

| | | | |
|---|---|---|---|
| CN | 109535376 | A | 3/2019 |
| CN | 111875775 | A | 11/2020 |
| CN | 111893642 | A | 11/2020 |
| CN | 113881005 | A | 1/2022 |
| CN | 114574143 | A | 6/2022 |
| CN | 115045006 | A | 9/2022 |
| CN | 116288929 | A | 6/2023 |
| CN | 116622051 | A | 8/2023 |
| CN | 117626677 | A | 3/2024 |
| KR | 102331834 | B1 | 12/2021 |

OTHER PUBLICATIONS

Yanjing Fan, Surface functionalization modification and antimicrobial properties of polyurethane materials, Chinese Master's Theses Full-text Database Engineering Science and Technology I, 2015, pp. 8, 28-30, 38-39, vol. 11.

GB/T2791-1995, Adhesives, T peel strength test method for a flexible-to-flexible test specimen assembly, The State Bureau of Quality and Technical Supervision of the People's Republic of China, 1995, China National Standards.

Yang Shiyu, et al., Structure and antibacterial properties of polyurethane nanofiber membranes modified with N- halamine compound, 2023, pp. 1-6, No. 7.

GB/T 20944.Jan. 2007, Textiles—Evaluation for antibacterial activity—Part 1: Agar diffusion plate method, General Administration of Quality Supervision, Inspection and Quarantine of the People's Republic of China, Standardization Administration of China, 2008, China National Standards.

Jinmei Wang, et al., Development and application of healthy textiles, 2005, pp. 159-162, China Textile Press.

RENEWABLE ANTIBACTERIAL WATERBORNE POLYURETHANE SYNTHETIC LEATHER WITH HIGH PEEL STRENGTH AND PREPARATION METHOD THEREOF

CROSS REFERENCE TO THE RELATED APPLICATIONS

This is a continuation application of the national phase entry of International Application No. PCT/CN2024/104913, filed on Jul. 11, 2024, which is based upon and claims priority to Chinese Patent Application No. 202410103083.0, filed on Jan. 25, 2024, the entire contents of which are incorporated herein by reference.

TECHNICAL FIELD

The present invention relates to the technical field of synthetic leather, and in particular, to a renewable antibacterial waterborne polyurethane synthetic leather with high peel strength and a preparation method thereof.

BACKGROUND

Synthetic leather is usually a simulated leather product made of a non-woven fabric serving as the base material, coated with polyurethane or polyvinyl chloride on the surface and processed by film. Polyurethane synthetic leather is widely applied to shoes, furniture, clothing, luggage, and automotive interiors due to the characteristics of excellent wear resistance, folding resistance, water resistance, moisture permeability and weather resistance, and has become an optimal choice for replacing natural leather. However, these leather products are in close contact with the human body and are prone to absorb sweat and sebum containing metabolites from sweat of skin, providing a nutrient source for the derivative reproduction of bacteria. The derivative reproduction of bacteria not only produces unpleasant odors and reduces the application performance of the products (such as discoloration and reduced mechanical strength), but also even threatens human health and life safety (such as causing skin diseases, and entering the body to induce diseases).

A halamine antimicrobial agent refers to an antimicrobial agent with a molecular structure containing one or more N—X structures (X is Cl, Br and other halogens), and is a renewable antimicrobial agent prepared by reacting a compound containing amine, amide or imide groups with hypohalite. The molecular structure of the halamine compound can introduce double bonds (C=C) (such as ADMH and VBDMH), hydroxyl (—OH) (such as MDMH), silicon hydroxyl (Si—OH) (such as DTH) and other active groups, which can improve the bonding strength between the antibacterial agent and the matrix through valence bond bonding, thereby improving the antibacterial durability of the grafted modified material. The halamine antibacterial agent has been the focus of research for the antibacterial material due to the high efficiency, broad spectrum and non-mutagenicity. Patent Application No. 202010796537.9 discloses a preparation method of an antibacterial polyurethane nanofiber. The specific method comprises: grafting a hydrophilic polyacrylic acid polymer onto a tetraalkylpiperidinol monomer, and blending with hydrophobic polyurethane, and preparing a nanofiber membrane with a certain hydrophilic/hydrophobic polymer interpenetrating network structure by electrospinning. According to Patent Application No. 202310346920.8 and "Structure and Antibacterial Properties of Polyurethane Nanofiber Membrane Modified by Halamine Compounds" (Printing and Dyeing, 2023, (7):1-6), 1-hydroxymethyl-5,5-dimethylhydantoin (MDMH) is used as a monomer, which is grafted into the structure during the polyurethane synthesis process and then prepared into a nanofiber membrane by electrospinning. The molecular structures of the tetraalkylpiperidinol monomer and the MDMH only contain one hydroxyl group, which can easily cause the linear polyurethane molecular chain to undergo end-capping termination reactions, making it difficult to control the molecular weight of the polyurethane; and the molecular weight distribution relatively broad, which in turn affects the performance of the nanofiber membrane. Patent Application No. 202210809792.1 discloses a preparation method of a polyurethane nanofiber material for air purification, which comprises firstly pre-polymerizing polycaprolactone and methylene diphenyl diisocyanate, then participating in the polymerization reaction of polyurethane by utilizing two hydroxyl groups (—OH) in imidazolidinyl urea, then mixing the imidazolidinyl urea modified polyurethane with common polyurethane, and finally preparing the antibacterial nanofiber through electrospinning. Although this method solves the influence of the antibacterial monomer on the molecular weight of the polyurethane, it is relatively expensive.

The data show that although N—Cl halamines have excellent antibacterial properties and renewability, the instability of the N—Cl bond under long-wave ultraviolet light of 315-400 nm causes the active chlorine content to decrease rapidly in a short period of time, leading to the rapid decrease in the antibacterial properties of the material. At present, although there have been many reports on the use of halamine structural compounds to impart durable and renewable antibacterial properties to polyurethane, there have been no reports on how to improve the light resistance of the antibacterial properties of N—Cl halamine-modified waterborne polyurethane.

The waterborne polyurethane is a novel polyurethane system that uses water instead of organic solvents as a dispersion medium. Compared with solvent-based polyurethane, although the waterborne polyurethane has the advantage of environmental protection, the bonding strength between the waterborne polyurethane and leather base fabric is low, which makes it easy for the surface layer and the base fabric of the synthetic leather to peel off. At present, there are two main common methods to improve peel strength, wherein one method is to apply a layer of adhesive between the surface layer and the base fabric (Patent Application No. 202210204113.8), and the other is to introduce epoxy resin into the polyurethane structure. Although these two commonly used methods are relatively effective, they only consider the effects of surface resin and adhesive, and do not consider the fiber structure of the base fabric, resulting in limited improvement.

SUMMARY

An objective of the present invention is to provide a renewable antibacterial waterborne polyurethane synthetic leather with high peel strength and a preparation method thereof, which solve the problems of low bonding strength between synthetic leather base fabric and polyurethane emulsion prepared by prior art, easy peeling and poor antibacterial properties of the polyurethane emulsion.

To achieve the above objective, the present invention provides the following technical solutions.

The present invention provides a preparation method of a renewable antibacterial waterborne polyurethane synthetic leather with high peel strength, which comprises the following steps:

impregnating a base fabric in a surface modification liquid to form a surface modification layer on the surface of the base fabric to obtain a pretreated base fabric;

coating a renewable and durable antibacterial waterborne polyurethane emulsion on release paper, and drying to obtain a polyurethane surface layer; adhering the pretreated base fabric to a polyurethane surface layer, drying, and then stripping the release paper to obtain a base fabric containing a polyurethane layer;

chloridizing the base fabric containing the polyurethane layer to obtain the renewable antibacterial waterborne polyurethane synthetic leather with high peel strength;

wherein a preparation method of the renewable and durable antibacterial waterborne polyurethane emulsion comprises the following steps:

(1) mixing polymer diol and diisocyanate for reaction to obtain a mixture a;

(2) mixing the mixture a, dibutyltin dilaurate and N,N-dimethylformamide for reaction to obtain a mixture b;

(3) mixing the mixture b, a chain extender, epoxy resin and N,N-dimethylformamide for reaction to obtain a mixture c;

(4) mixing the mixture c, a halamine antibacterial monomer, an ultraviolet absorbent and N,N-dimethylformamide for reaction to obtain a mixture d;

(5) mixing the mixture d, an antioxidant, triethylamine and N,N-dimethylformamide for neutralization reaction to obtain a mixture e;

(6) adjusting the viscosity of the mixture e by using N,N-dimethylformamide, and then mixing the mixture e with water and diethylenetriamine for emulsification to obtain the renewable and durable antibacterial waterborne polyurethane emulsion;

the halamine antibacterial monomer in the step (4) is 3-(2,3-dihydroxypropyl)-5,5-dimethylhydantoin and has the structural formula as follows:

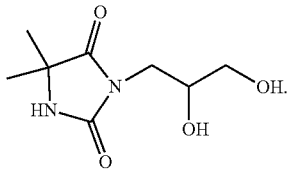

Preferably, in the preparation method of the renewable antibacterial waterborne polyurethane synthetic leather with high peel strength, the base fabric is one of a polyester filament knitted fabric, a polyester filament woven fabric, a polyester staple fiber knitted fabric, a polyester staple fiber woven fabric, a polyester staple fiber spunlace non-woven fabric and a polyester staple fiber needle-punched non-woven fabric.

Preferably, in the preparation method of the renewable antibacterial waterborne polyurethane synthetic leather with high peel strength, the surface modification liquid comprises the following components: 10-15 mL/L of benzyl alcohol, 0.3-0.5 g/L of accelerator and 15-20 g/L of sodium hydroxide;

the liquor ratio of the impregnation is 1:(5-10); and the impregnation is performed at a temperature of 100-120° C. for 20-30 min.

Preferably, in the preparation method of the renewable antibacterial waterborne polyurethane synthetic leather with high peel strength, the renewable and durable antibacterial waterborne polyurethane emulsion is coated on the release paper in an amount of 150-200 g/m$^2$.

Preferably, in the preparation method of the renewable antibacterial waterborne polyurethane synthetic leather with high peel strength, the chlorination treatment is impregnating in a sodium hypochlorite solution; the available chlorine content of the sodium hypochlorite solution is 3000 ppm; the liquor ratio of the impregnation is 1:(5-10); and the impregnation is performed for 20-30 min.

Preferably, according to the preparation method of the renewable antibacterial waterborne polyurethane synthetic leather with high peel strength, in the preparation method of the renewable and durable antibacterial waterborne polyurethane emulsion, the mass ratio of the polymer diol and diisocyanate in the step (1) is (30-40):(15-20);

the reaction in the step (1) is performed at a temperature of 60-65° C., and the reaction in the step (1) is performed for 60-90 min;

the mass-to-volume ratio of the polymer diol in the step (1) to the dibutyltin dilaurate and the N,N-dimethylformamide in the step (2) is (30-40) g:(0.1-0.3) g:(10-20) mL;

the reaction in the step (2) is performed at a temperature of 70-75° C., and the reaction in the step (2) is performed for 90-120 min; and the mass-to-volume ratio of the polymer diol in the step (1) to the chain extender, the epoxy resin and the N,N-dimethylformamide in the step (3) is (30-40) g:(3-5) g:(5-8) g:(15-20) mL;

the reaction in the step (3) is performed at a temperature of 80-90° C., and the reaction in the step (3) is performed for 30-45 min.

Preferably, according to the preparation method of the renewable antibacterial waterborne polyurethane synthetic leather with high peel strength, in the preparation method of the renewable and durable antibacterial waterborne polyurethane emulsion, the ultraviolet absorbent in the step (4) is 2,4-dihydroxybenzophenone;

the mass-to-volume ratio of the polymer diol in the step (1) to the halamine antibacterial monomer, the ultraviolet absorber and the N,N-dimethylformamide in the step (4) is (30-40) g:(1-3) g:(2-5) g:(15-25) mL; and the reaction in the step (4) is performed at a temperature of 80-90° C., and the reaction in the step (4) is performed for 60-90 min.

Preferably, according to the preparation method of the renewable antibacterial waterborne polyurethane synthetic leather with high peel strength, in the preparation method of the renewable and durable antibacterial waterborne polyurethane emulsion, the mass-to-volume ratio of the polymer diol in the step (1) to the antioxidant, the triethylamine and the N,N-dimethylformamide in the step (5) is (30-40) g:(0.01-0.1) g:(3-5) g:(5-15) mL;

the neutralization reaction in the step (5) is performed at a temperature of 50-60° C., and the neutralization reaction in the step (5) is performed for 30-60 min.

Preferably, according to the preparation method of the renewable antibacterial waterborne polyurethane synthetic leather with high peel strength, in the preparation method of the renewable and durable antibacterial waterborne polyurethane emulsion, the viscosity in the step (6) is 7000-8000 Pa/s;

the mass-to-volume ratio of the polymer diol in the step (1) to the water and the diethylenetriamine in the step (6) is (30-40) g:(200-300) mL:(0.5-1) mL;

the emulsification in the step (6) is performed at a temperature of 25-30° C.; and the emulsification in the step (6) is performed for 60-90 min.

The present invention further provides a renewable antibacterial waterborne polyurethane synthetic leather with high peel strength prepared by the preparation method of the renewable antibacterial waterborne polyurethane synthetic leather with high peel strength.

It can be known from the technical solutions that, compared with the prior art, the present invention has the following beneficial effects.

(1) The preparation condition of the renewable and durable antibacterial waterborne polyurethane emulsion is controllable, the polymer diol, the diisocyanate, the halamine antibacterial monomer and the ultraviolet absorbent are polymerized in one step, the reaction steps are simple, and the reaction is basically performed at the medium-low temperature of below 100° C.

(2) The film formed by coating the waterborne polyurethane emulsion has lasting antibacterial property, the used halamine antibacterial monomer structure does not contain a hydrogen, and an ultraviolet absorbent is simultaneously connected into the polyurethane structure, so that the influence of ultraviolet rays in sunlight on the stability of N—Cl bonds is weakened, the stability of the N—Cl bonds is improved, and the antibacterial durability of a polyurethane coating film is improved. Moreover, the antibacterial property is also renewable, and the halamine antibacterial monomer structure can obtain antibacterial renewable properties through repeated dehalogenation and halogenation.

(3) The synthetic leather has high peel strength between the polyurethane surface layer and the base fabric. Firstly, the bonding property of polyurethane is improved by copolymerizing epoxy resin; secondly, a microscopic rough structure is constructed on the surface of the base fabric by alkali reduction and surface modification of the base fabric; and then, the mechanical meshing effect of the microscopic rough structure and the polyurethane is utilized to further improve the bonding strength between the polyurethane surface layer and the base fabric.

BRIEF DESCRIPTION OF THE DRAWINGS

To more clearly illustrate the technical solutions in the examples of the present invention or in the prior art, the drawings used in the description of the examples or the prior art are briefly introduced below.

DETAILED DESCRIPTION OF THE EMBODIMENTS

Figure 1:
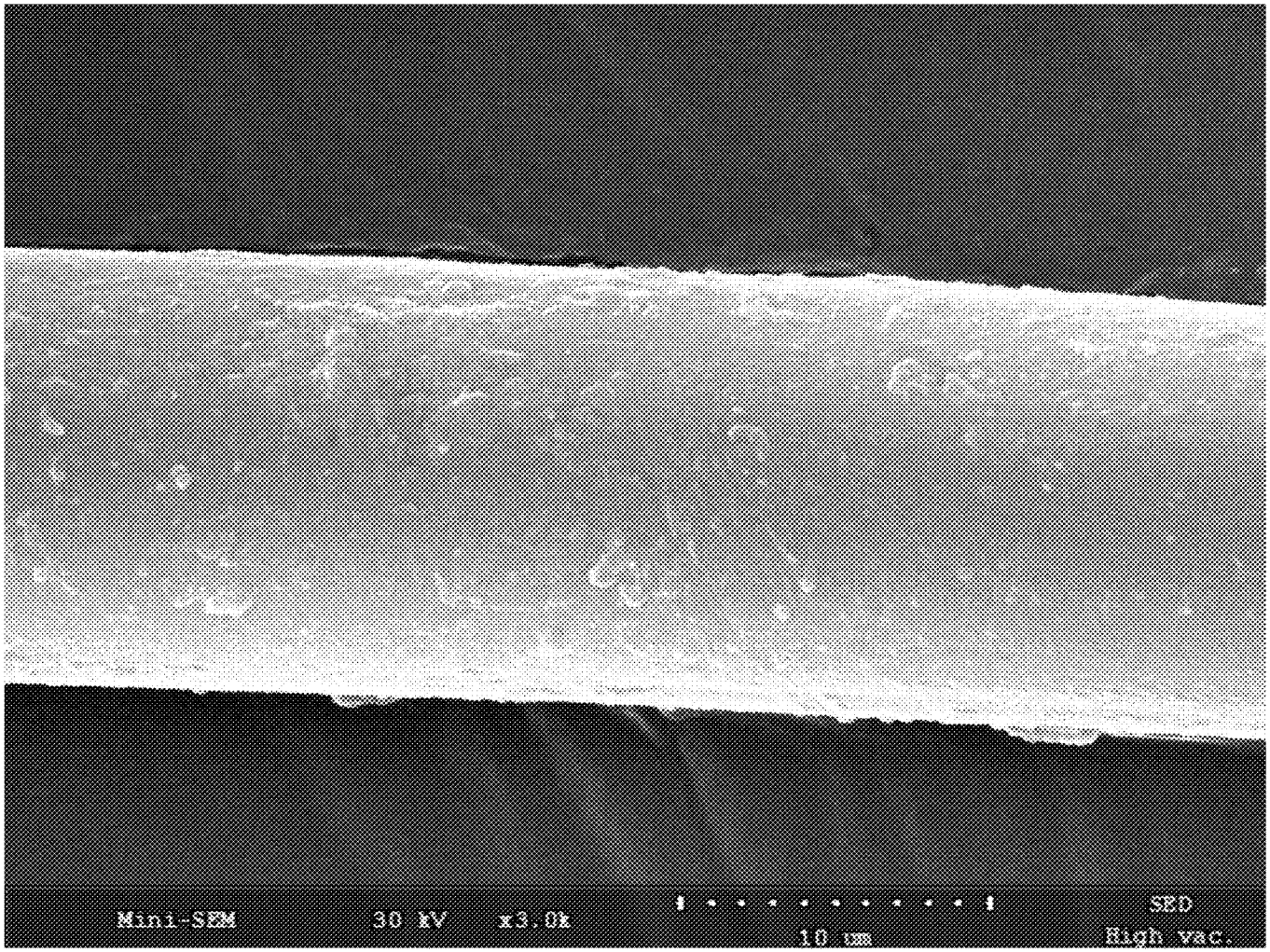
FIG. 1 is an SEM image of the surface-modified base fabric fiber in step (1) according to Example 1.

The present invention provides a preparation method of a renewable antibacterial waterborne polyurethane synthetic leather with high peel strength, which comprises the following steps:

impregnating a base fabric in a surface modification liquid to form a surface modification layer on the surface of the base fabric to obtain a pretreated base fabric;

coating a renewable and durable antibacterial waterborne polyurethane emulsion on release paper, and drying to obtain a polyurethane surface layer; adhering the pretreated base fabric to a polyurethane surface layer, drying, and then stripping the release paper to obtain a base fabric containing a polyurethane layer; and chloridizing the base fabric containing the polyurethane layer to obtain the renewable antibacterial waterborne polyurethane synthetic leather with high peel strength.

In the present invention, the base fabric is preferably one of a polyester filament knitted fabric, a polyester filament woven fabric, a polyester staple fiber knitted fabric, a polyester staple fiber woven fabric, a polyester staple fiber spunlace non-woven fabric and a polyester staple fiber needle-punched non-woven fabric; further preferably a polyester filament woven fabric, a polyester staple fiber woven fabric and a polyester staple fiber spunlace non-woven fabric; and more preferably a polyester staple fiber woven fabric.

In the present invention, the surface modification liquid preferably comprises the following components: 10-15 mL/L of benzyl alcohol, 0.3-0.5 g/L of accelerator and 15-20 g/L of sodium hydroxide; further preferably 11-14 mL/L of benzyl alcohol, 0.35-0.45 g/L of accelerator and 17-19 g/L of sodium hydroxide; and more preferably 12 mL/L of benzyl alcohol, 0.4 g/L of accelerator and 18 g/L of sodium hydroxide.

In the present invention, the accelerator is preferably one of dodecyl dimethyl benzyl ammonium chloride, hexadecyl trimethyl ammonium bromide and octadecyl dimethyl hydroxyethyl ammonium nitrate; further preferably dodecyl dimethyl benzyl ammonium chloride or hexadecyl trimethyl ammonium bromide; and more preferably dodecyl dimethyl benzyl ammonium chloride.

In the present invention, the liquor ratio of the impregnation is preferably 1:(5-10), further preferably 1:(6-10), and more preferably 1:10; the impregnation is performed at a temperature of preferably 100-120° C., further preferably 105-115° C., and more preferably 110° C.; and the impregnation is performed for preferably 20-30 min, further preferably 25-30 min, and more preferably 30 min.

In the present invention, the renewable and durable antibacterial waterborne polyurethane emulsion is coated on the release paper in an amount of preferably 150-200 g/m$^2$, further preferably 160-180 g/m$^2$, and more preferably 170 g/m$^2$.

In the present invention, the renewable and durable antibacterial waterborne polyurethane emulsion is dried preferably at 110° C. for 5 min after being coated on release paper. In the present invention, the adhering is performed at a speed of 7 m/min.

In the present invention, the pretreated base fabric is dried preferably at 130° C. for 3 min after being adhered to the polyurethane surface layer.

In the present invention, the chlorination treatment is preferably impregnating in a sodium hypochlorite solution; the available chlorine content of the sodium hypochlorite solution is preferably 3000 ppm; the liquor ratio of the impregnation is preferably 1:(5-10), further preferably 1:(5-7), and more preferably 1:5; and the impregnation is performed for preferably 20-30 min, further preferably 22-30 min, and more preferably 30 min.

The present invention further provides a preparation method of the renewable and durable antibacterial waterborne polyurethane emulsion, which comprises the following steps: (1) mixing polymer diol and diisocyanate for reaction to obtain a mixture a;

(2) mixing the mixture a, dibutyltin dilaurate and N,N-dimethylformamide for reaction to obtain a mixture b;

(3) mixing the mixture b, a chain extender, epoxy resin and N,N-dimethylformamide for reaction to obtain a mixture c;

(4) mixing the mixture c, a halamine antibacterial monomer, an ultraviolet absorbent and N,N-dimethylformamide for reaction to obtain a mixture d;

(5) mixing the mixture d, an antioxidant, triethylamine and N,N-dimethylformamide for neutralization reaction to obtain a mixture e; and (6) adjusting the viscosity of the mixture e by using N,N-dimethylformamide, and then mixing the mixture e with water and diethylenetriamine for emulsification to obtain the renewable and durable antibacterial waterborne polyurethane emulsion.

In the present invention, the polymer diol in the step (1) is further subjected to dehydration treatment before use; the dehydration treatment is performed at a temperature of preferably 80° C.; and the dehydration treatment is performed for preferably 2 h.

In the present invention, the polymer diol in the step (1) is preferably a mixture of polycaprolactone polyol (PLG) and polyester diol (PBA2000) in a mass ratio of 1:2.

In the present invention, the diisocyanate in the step (1) is preferably a mixture of isophorone diisocyanate (IPDI) and dicyclohexylmethane diisocyanate (HMDI) in a mass ratio of 3:1.

In the present invention, the mass ratio of the polymer diol to the diisocyanate in the step (1) is preferably (30-40):(15-20), further preferably (30-35):(17-20), and more preferably 30:20.

In the present invention, the reaction in the step (1) is performed at a temperature of preferably 60-65° C., further preferably 63-65° C., and more preferably 65° C.; and the reaction in the step (1) is performed for preferably 60-90 min, further preferably 70-90 min, and more preferably 80 min.

In the present invention, the mass-to-volume ratio of the polymer diol in the step (1) to the dibutyltin dilaurate and the N,N-dimethylformamide in the step (2) is (30-40) g:(0.1-0.3) g):(10-20) mL, further preferably (30-35) g:(0.1-0.2) g:(12-18) mL, and more preferably 30 g:0.1 g: 15 mL.

In the present invention, the reaction in the step (2) is performed at a temperature of preferably 70-75° C., further preferably 70-73° C., and more preferably 70° C.; and the reaction in the step (2) is performed for preferably 90-120 min, further preferably 100-115 min, and more preferably 110 min.

In the present invention, the mixing in the step (2) is preferably as follows: preliminarily mixing dibutyltin dilaurate with the mixture a at the reaction temperature in the step (1), and then adding N,N-dimethylformamide into a mixed system consisting of the mixture a and dibutyltin dilaurate in an equal amount for 2-5 times in the process of raising the reaction temperature in the step (1) to the reaction temperature in the step (2) to complete mixing.

In the present invention, the mass-to-volume ratio of the polymer diol in the step (1) to the chain extender, the epoxy resin and the N,N-dimethylformamide in the step (3) is (30-40) g:(3-5) g:(5-8) g:(15-20) mL; further preferably (30-35) g:(3.2-4.5) g:(6-8) g:(18-20) mL; and more preferably 30 g:4 g:8 g:20 mL.

In the present invention, the reaction in the step (3) is performed at a temperature of preferably 80-90° C., further preferably 80-86° C., and more preferably 85° C.; and the reaction in the step (3) is performed for preferably 30-45 min, further preferably 40-45 min, and more preferably 45 min.

In the present invention, the chain extender in the step (3) is preferably 1,4-butanediol (BDO).

In the present invention, the epoxy resin in the step (3) is preferably epoxy resin E51.

In the present invention, the halamine antibacterial monomer in the step (4) is preferably 3-(2,3-dihydroxypropyl)-5,5-dimethylhydantoin and has the structural formula as follows:

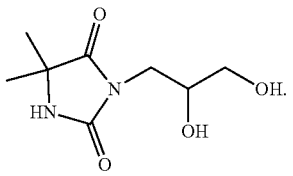

In the present invention, a preparation method of 3-(2,3-dihydroxypropyl)-5,5-dimethylhydantoin comprises the following steps: dissolving 0.01 mol of 5,5-dimethylhydantoin in 50 mL of deionized water, stirring uniformly, adding 0.02 mol of NaOH, and placing in a 250 mL flat-bottomed flask for later use after completely dissolving; dissolving 0.01 mol of 3-chloroglycerol in 50 mL of deionized water, slowly and dropwise adding the solution into the 5,5-dimethylhydantoin solution for the next reaction, and fully reacting for 12 h at room temperature under the action of magnetic stirring; after the reaction is completed, adjusting the pH value of the reaction solution to 6.0 by using dilute sulfuric acid; then removing the moisture of the solution after the reaction by using a rotary evaporator, and dissolving the obtained solid in DMF to remove a reaction byproduct NaCl through filtration; then distilling DMF in the filtrate off under reduced pressure to obtain 3-(2,3-dihydroxypropyl)-5,5-dimethylhydantoin.

In the present invention, the ultraviolet absorber in the step (4) is preferably 2,4-dihydroxybenzophenone.

In the present invention, the mass-to-volume ratio of the polymer diol in the step (1) to the halamine antibacterial monomer, the ultraviolet absorber and the N,N-dimethylformamide in the step (4) is (30-40) g:(1-3) g:(2-5) g:(15-25) mL; further preferably (30-35) g:(1-2) g:(3-5) g:(18-23) mL; and more preferably 30 g:2 g:4 g:20 mL.

In the present invention, the reaction in the step (4) is performed at a temperature of preferably 80-90° C., further preferably 80-85° C., and more preferably 80° C.; and the reaction in the step (4) is performed for preferably 60-90 min, further preferably 70-90 min, and more preferably 90 min.

In the present invention, the mass-to-volume ratio of the polymer diol in the step (1) to the antioxidant, the triethylamine and the N,N-dimethylformamide in the step (5) is (30-40) g:(0.01-0.1) g:(3-5) g:(5-15) mL; further preferably (30-35) g:(0.04-0.07) g:(4-5) g:(10-15) mL; and more preferably 30 g:0.06 g:4 g:10 mL.

In the present invention, the neutralization reaction in the step (5) is performed at a temperature of preferably 50-60° C., further preferably 52-56° C., and more preferably 55° C.;

and the neutralization reaction in the step (5) is performed for preferably 30-60 min, further preferably 40-60 min, and more preferably 50 min.

In the present invention, the antioxidant in the step (5) is preferably an antioxidant 1010.

In the present invention, the viscosity in the step (6) is preferably 7000-8000 Pa/s; further preferably 7000-7500 Pa/s; and more preferably 7000 Pa/s.

In the present invention, the mass-to-volume ratio of the polymer diol in the step (1) to the water and the diethylenetriamine in the step (6) is (30-40) g:(200-300) mL:(0.5-1) mL; further preferably (30-35) g:(200-250) mL:(0.6-0.9) mL; and more preferably 30 g:200 mL: 0.8 mL.

In the present invention, the emulsification in the step (6) is performed at a temperature of preferably 25-30° C., further preferably 25-28° C., and more preferably 27° C.; and the emulsification in the step (6) is performed for preferably 60-90 min, further preferably 80-90 min, and more preferably 90 min.

In the present invention, the mixing in the step (6) is preferably as follows: firstly, adding the first part of water under stirring condition, quickly adding the rest water after phase inversion is successful, and then adding diethylenetriamine for emulsification.

In the present invention, the stirring is performed at a speed of preferably 1500 rpm.

In the present invention, the temperature of the water in the step (6) is preferably 5° C.

The present invention further provides a renewable antibacterial waterborne polyurethane synthetic leather with high peel strength prepared by the preparation method of the renewable antibacterial waterborne polyurethane synthetic leather with high peel strength.

The technical solutions in the examples of the present invention will be clearly and completely described below. Apparently, the described examples are merely a part, rather than all of the examples of the present invention. Based on the embodiments of the present invention, all other embodiments obtained by those of ordinary skill in the art without creative efforts shall fall within the protection scope of the present invention.

Example 1

This example provides a renewable antibacterial waterborne polyurethane synthetic leather with high peel strength, which is prepared by the following steps:

(1) impregnating a base fabric (a polyester filament knitted fabric) in a surface modification liquid in a liquor ratio of 1:5 at 110° C. for 30 min to form a surface modification layer on the surface of the base fabric to obtain a pretreated base fabric; wherein the surface modification liquid comprises the following components: 10 mL/L of benzyl alcohol, 0.5 g/L of hexadecyl trimethyl ammonium bromide and 15 g/L of sodium hydroxide;

(2) coating a renewable and durable antibacterial waterborne polyurethane emulsion on release paper, wherein the coating amount is 200 g/m$^2$, drying in an oven at the temperature of 110° C. for 5 min to obtain a polyurethane surface layer, adhering the polyurethane surface layer to the surface of the pretreated base fabric at the speed of 7 m/min, drying in the oven at the temperature of 130° C. for 3 min, and removing the release paper to obtain the base fabric containing the polyurethane layer;

(3) impregnating the base fabric containing the polyurethane layer into a sodium hypochlorite solution with the available chlorine content of 3000 ppm in a liquor ratio of 1:5 for 30 min to obtain the renewable antibacterial waterborne polyurethane synthetic leather with high peel strength.

The preparation method of the renewable and durable antibacterial waterborne polyurethane emulsion in the step (2) comprises the following steps:

adding 30 g of polymer diol (a mixture of PLG and PBA2000 in a mass ratio of 1:2) into a reaction device, heating to 80° C. under a vacuum condition, dehydrating for 2 h, cooling to 50° C., adding 20 g of diisocyanate (a mixture of IPDI and HMDI in a mass ratio of 3:1), heating to 60° C., and reacting at a constant temperature for 60 min to obtain a mixture a; adding 0.1 g of dibutyltin dilaurate into the mixture a, heating to 70° C., adding 15 mL of N,N-dimethylformamide (DMF) in total in 3 times in the heating process, and continuing to react for 90 min to obtain a mixture b; adding 4 g of chain extender BDO, 5 g of epoxy resin E51 and 20 mL of DMF into the mixture b, heating to 80° C., and reacting at constant temperature for 40 min to obtain a mixture c; adding 2 g of the halamine antibacterial monomer, 3 g of ultraviolet absorbent 2,4-dihydroxybenzophenone and 20 mL of DMF into the mixture c, and continuing to react for 60 min to obtain a mixture d; cooling to 55° C., adding 0.06 g of antioxidant 1010, 3 g of triethylamine and 10 mL of DMF into the mixture d, and performing neutralization reaction for 45 min to obtain a mixture e; adjusting the viscosity of the mixture e to 7000 Pa/s by using DMF, slowly adding deionized water at 5° C. under the stirring condition at 1500 rpm, quickly adding the rest deionized water after phase inversion is successful, wherein the total addition amount of the deionized water is 200 mL, then adding 0.8 mL of diethylenetriamine, continuously emulsifying for 90 min at 25° C., and removing an organic solvent to obtain the renewable and durable antibacterial waterborne polyurethane emulsion.

Example 2

This example provides a renewable antibacterial waterborne polyurethane synthetic leather with high peel strength, which is prepared by the following steps:

(1) impregnating a base fabric (a polyester filament knitted fabric) in a surface modification liquid in a liquor ratio of 1:10 at 100° C. for 20 min to form a surface modification layer on the surface of the base fabric to obtain a pretreated base fabric; wherein the surface modification liquid comprises the following components: 12 mL/L of benzyl alcohol, 0.3 g/L of hexadecyl trimethyl ammonium bromide and 16 g/L of sodium hydroxide;

(2) coating a renewable and durable antibacterial waterborne polyurethane emulsion on release paper, wherein the coating amount is 180 g/m$^2$, drying in an oven at the temperature of 110° C. for 5 min to obtain a polyurethane surface layer, adhering the polyurethane surface layer to the surface of the pretreated base fabric at the speed of 7 m/min, drying in the oven at the temperature of 130° C. for 3 min, and removing the release paper to obtain the base fabric containing the polyurethane layer;

(3) impregnating the base fabric containing the polyurethane layer into a sodium hypochlorite solution with the available chlorine content of 3000 ppm in a liquor ratio of 1:8 for 25 min to obtain the renewable antibacterial waterborne polyurethane synthetic leather with high peel strength.

The preparation method of the renewable and durable antibacterial waterborne polyurethane emulsion in the step (2) comprises the following steps:

adding 35 g of polymer diol (a mixture of PLG and PBA2000 in a mass ratio of 1:2) into a reaction device, heating to 80° C. under a vacuum condition, dehydrating for 2 h, cooling to 50° C., adding 16 g of diisocyanate (a mixture of IPDI and HMDI in a mass ratio of 3:1), heating to 65° C., and reacting at a constant temperature for 70 min to obtain a mixture a; adding 0.3 g of dibutyltin dilaurate into the mixture a, heating to 73° C., adding 18 mL of N,N-dimethylformamide (DMF) in total in 3 times in the heating process, and continuing to react for 100 min to obtain a mixture b; adding 3 g of chain extender BDO, 7 g of epoxy resin E51 and 20 mL of DMF into the mixture b, heating to 85° C., and reacting at constant temperature for 45 min to obtain a mixture c; adding 1 g of the halamine antibacterial monomer, 4 g of ultraviolet absorbent 2,4-dihydroxybenzophenone and 20 mL of DMF into the mixture c, and continuing to react for 80 min to obtain a mixture d; cooling to 50° C., adding 0.03 g of antioxidant 1010, 4 g of triethylamine and 15 mL of DMF into the mixture d, and performing neutralization reaction for 50 min to obtain a mixture e; adjusting the viscosity of the mixture e to 7500 Pa/s by using DMF, slowly adding deionized water at 5° C. under the stirring condition at 1500 rpm, quickly adding the rest deionized water after phase inversion is successful, wherein the total addition amount of the deionized water is 260 mL, then adding 0.6 mL of diethylenetriamine, continuously emulsifying for 70 min at 25° C., and removing an organic solvent to obtain the renewable and durable antibacterial waterborne polyurethane emulsion.

Example 3

This example provides a renewable antibacterial waterborne polyurethane synthetic leather with high peel strength, which is prepared by the following steps:

(1) impregnating a base fabric (a polyester filament knitted fabric) in a surface modification liquid in a liquor ratio of 1:10 at 120° C. for 25 min to form a surface modification layer on the surface of the base fabric to obtain a pretreated base fabric; wherein the surface modification liquid comprises the following components: 15 mL/L of benzyl alcohol, 0.4 g/L of hexadecyl trimethyl ammonium bromide and 20 g/L of sodium hydroxide;

(2) coating a renewable and durable antibacterial waterborne polyurethane emulsion on release paper, wherein the coating amount is 150 g/m$^2$, drying in an oven at the temperature of 110° C. for 5 min to obtain a polyurethane surface layer, adhering the polyurethane surface layer to the surface of the pretreated base fabric at the speed of 7 m/min, drying in the oven at the temperature of 130° C. for 3 min, and removing the release paper to obtain the base fabric containing the polyurethane layer;

(3) impregnating the base fabric containing the polyurethane layer into a sodium hypochlorite solution with the available chlorine content of 3000 ppm in a liquor ratio of 1:10 for 30 min to obtain the renewable antibacterial waterborne polyurethane synthetic leather with high peel strength.

The preparation method of the renewable and durable antibacterial waterborne polyurethane emulsion in the step (2) comprises the following steps:

adding 40 g of polymer diol (a mixture of PLG and PBA2000 in a mass ratio of 1:2) into a reaction device, heating to 80° C. under a vacuum condition, dehydrating for 2 h, cooling to 50° C., adding 15 g of diisocyanate (a mixture of IPDI and HMDI in a mass ratio of 3:1), heating to 60° C., and reacting at a constant temperature for 90 min to obtain a mixture a; adding 0.3 g of dibutyltin dilaurate into the mixture a, heating to 70° C., adding 15 mL of N,N-dimethylformamide (DMF) in total in 3 times in the heating process, and continuing to react for 90 min to obtain a mixture b; adding 5 g of chain extender BDO, 8 g of epoxy resin E51 and 20 mL of DMF into the mixture b, heating to 90° C., and reacting at constant temperature for 40 min to obtain a mixture c; adding 3 g of the halamine antibacterial monomer, 5 g of ultraviolet absorbent 2,4-dihydroxybenzophenone and 20 mL of DMF into the mixture c, and continuing to react for 60 min to obtain a mixture d; cooling to 55° C., adding 0.01 g of antioxidant 1010, 3 g of triethylamine and 15 mL of DMF into the mixture d, and performing neutralization reaction for 60 min to obtain a mixture e; adjusting the viscosity of the mixture e to 8000 Pa/s by using DMF, slowly adding deionized water at 5° C. under the stirring condition at 1500 rpm, quickly adding the rest deionized water after phase inversion is successful, wherein the total addition amount of the deionized water is 200 mL, then adding 1 mL of diethylenetriamine, continuously emulsifying for 60 min at 25° C., and removing an organic solvent to obtain the renewable and durable antibacterial waterborne polyurethane emulsion.

Comparative Example 1

This comparative example provides a waterborne polyurethane synthetic leather, which is specifically shown in Example 1, except that the base fabric is not subjected to surface modification, and the halamine antibacterial monomer and the ultraviolet absorber are not added into the waterborne polyurethane emulsion.

Comparative Example 2

This comparative example provides a waterborne polyurethane synthetic leather, which is specifically shown in Example 1, except that the halamine antibacterial monomer and the ultraviolet absorber are not added into the waterborne polyurethane emulsion.

Comparative Example 3

This comparative example provides a waterborne polyurethane synthetic leather, which is specifically shown in Example 1, except that the base fabric is not subjected to surface modification, and the epoxy resin E51, the halamine antibacterial monomer and the ultraviolet absorber are not added into the waterborne polyurethane emulsion.

Comparative Example 4

This comparative example provides a waterborne polyurethane synthetic leather, which is specifically shown in Example 1, except that the ultraviolet absorber is not added into the waterborne polyurethane emulsion.

The renewable antibacterial waterborne polyurethane synthetic leather with high peel strength prepared in Example 1 and the waterborne polyurethane synthetic leather prepared in Comparative Examples 1 to 3 were subjected to peel strength tests according to the standard GB/T 2791-1995 Adhesive T Peel Strength Test Method: Flexible Materials to Flexible Materials. The test conditions were as follows: tensile rate 100 mm/min, gauge 100 mm. The test results are shown in Table 1.

Figure 2:
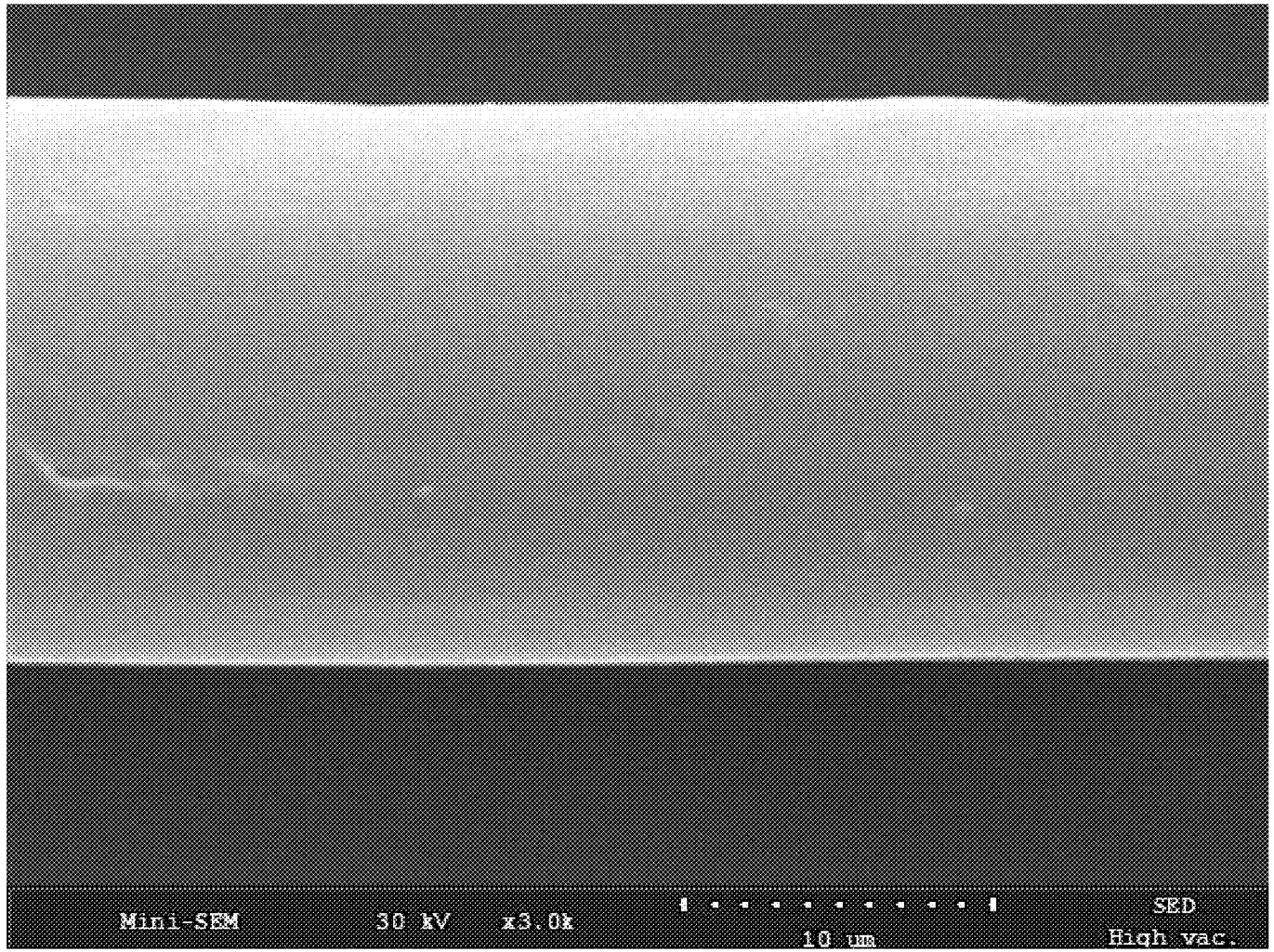
FIG. 2 is an SEM image of the non-surface-modified base fabric fiber according to Comparative Example 1.

SEM tests were performed on the surface-modified base fabric fiber in the step (1) of Example 1 and the non-surface-modified base fabric fiber in Comparative Example 1. The results are shown in FIGS. 1 and 2.

TABLE 1

Results of peel strength test

| Sample | Peel strength (kg/cm) |
|---|---|
| Example 1 | 3.51 |
| Comparative Example 1 | 2.78 |
| Comparative Example 2 | 3.53 |
| Comparative Example 3 | 1.86 |

It can be seen from the data in Table 1 that the peel strength between the aqueous polyurethane emulsion prepared by polymerization with epoxy resin E51 and the base fabric (Comparative Example 1) is significantly greater than that without epoxy resin E51 (Comparative Example 3), and the alkali reduction treatment can effectively improve the peel strength between the polyurethane resin and the base fabric. This is because alkali reduction can construct a microscopic rough structure on the fiber surface (referring to FIGS. 1 to 2), and the rough surface can produce mechanical meshing with the polyurethane surface layer to achieve the purpose of improving the peel strength. It can be seen from the peel strength of Example 1 and Comparative Example 2 that the addition of halamine antibacterial monomer and ultraviolet absorber (Example 1) does not have a significant effect on the peel strength.

The renewable antibacterial waterborne polyurethane synthetic leather with high peel strength prepared in Example 1 and the waterborne polyurethane synthetic leather prepared in Comparative Examples 2 and 4 were tested for antibacterial properties. The antibacterial rate was tested according to the standard "GB/T 20944.1-2007 Evaluation of Antibacterial Properties of Textiles Part 1: Agar Plate Diffusion Method". The washing method for washability is as follows: preparing 2 g/L washing liquid by using a phosphorus-free ECE standard synthetic detergent, soaking a sample in the washing liquid in a water bath at 25° C. for 10 min, fully cleaning with distilled water, drying, and marking as washing once; and the method for testing the light resistance comprises the following steps: irradiating the sample by a Q-SUN-Xe-2-HS type light fastness instrument under simulated sunlight condition, and then analyzing the antibacterial rate of the sample before and after irradiation. The results are shown in Table 2.

TABLE 2

Results of antibacterial property test

| | | | | Comparative Example 2 | Comparative Example 4 | Example 1 |
|---|---|---|---|---|---|---|
| Antibacterial rate/% | Washability | Unwashed | *Escherichia coli* | — | 99.99 | 99.99 |
| | | | *Staphylococcus aureus* | — | 99.99 | 99.99 |
| | | Washing 10 times | *Escherichia coli* | — | 94.01 | 93.31 |
| | | | *Staphylococcus aureus* | — | 91.91 | 91.61 |
| | | Washing 20 times | *Escherichia coli* | — | 83.21 | 85.26 |
| | | | *Staphylococcus aureus* | — | 81.66 | 82.05 |
| | Light resistance | Unexposed to light | *Escherichia coli* | — | 99.99 | 99.99 |
| | | | *Staphylococcus aureus* | — | 99.99 | 99.99 |
| | | Exposed to light for 24 h | *Escherichia coli* | — | 73.21 | 90.56 |
| | | | *Staphylococcus aureus* | — | 69.34 | 86.65 |
| | Renewability | $1^{st}$ halogenation | *Escherichia coli* | / | 99.99 | 99.99 |
| | | | *Staphylococcus aureus* | / | 99.99 | 99.99 |
| | | $2^{nd}$ halogenation | *Escherichia coli* | / | 99.25 | 99.39 |
| | | | *Staphylococcus aureus* | / | 98.36 | 98.21 |
| | | $5^{th}$ halogenation | *Escherichia coli* | / | 96.33 | 96.56 |
| | | | *Staphylococcus aureus* | / | 95.99 | 96.67 |

Note: "-" indicates no obvious antibacterial effect; and "/" indicates not measured.

Figure 3:
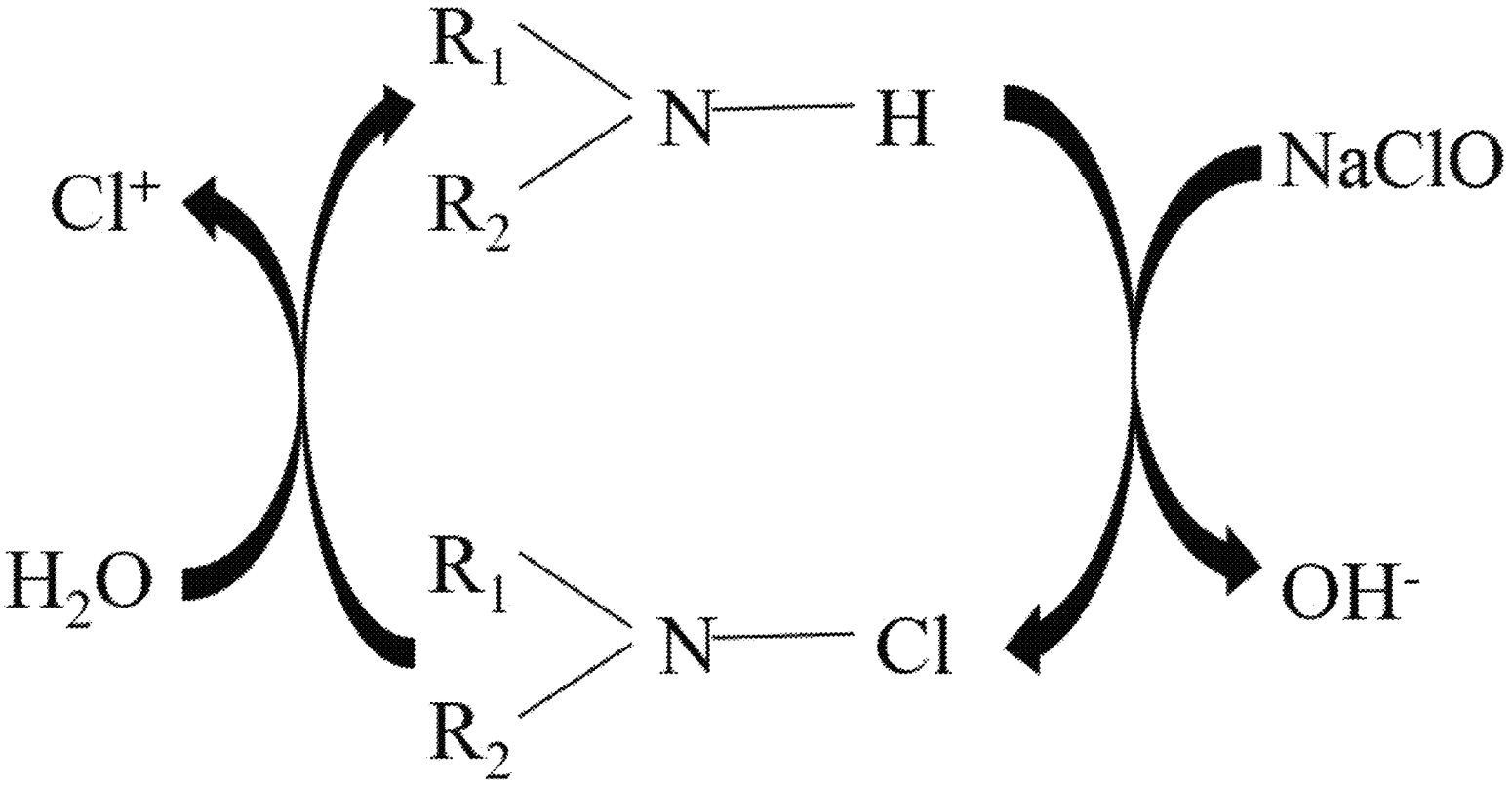
FIG. 3 is a schematic diagram of the dehalogenation and halogenation process of the halamine antibacterial monomer.

It can be seen from the data in Table 2 that the synthetic leather without adding halamine antibacterial monomer (Comparative Example 2) has no significant antibacterial effect, and the synthetic leather with adding halamine antibacterial monomer (Comparative Example 4 and Example 1) has good antibacterial effect and good washability. It can be seen from the comparison between Comparative Example 4 and Example 1 that the ultraviolet absorber has no significant effect on the washability of the synthetic leather, but can significantly improve the light resistance of the synthetic leather. The antibacterial renewability test was performed on the synthetic leather prepared in Example 1. The data in Table 2 show that the waterborne polyurethane emulsion containing the halamine antibacterial monomer has good antibacterial renewability, and the halamine antibacterial monomer can obtain antibacterial renewability through repeated dehalogenation and halogenation. The schematic diagram of the dehalogenation and halogenation process is shown in FIG. 3, N—H generates N—Cl under the action of sodium hypochlorite (NaClO), and N—Cl is hydrolyzed under the action of water to release $Cl^+$ and generate N—H at the same time. In addition, the ultraviolet absorber has no significant effect on the renewability of halamine antibacterial monomer.

The above descriptions are only preferred embodiments of the present invention. It should be noted that those of ordinary skill in the art can also make several improvements and modifications without departing from the principle of the present invention, and such improvements and modifications shall fall within the protection scope of the present invention.

What is claimed is:

1. A preparation method of a renewable antibacterial waterborne polyurethane synthetic leather with a high peel strength, comprising the following steps:

performing a first impregnation on a base fabric in a surface modification liquid to form a surface modification layer on a surface of the base fabric to obtain a pretreated base fabric; wherein the surface modification liquid comprises the following components: 10-15 mL/L of benzyl alcohol, 0.3-0.5 g/L of an accelerator, and 15-20 g/L of sodium hydroxide; a liquor ratio of the first impregnation is 1:(5-10); the first impregnation is performed at a temperature of 100-120° C. for 20-30 min;

coating a renewable and durable antibacterial waterborne polyurethane emulsion on a release paper, and drying to obtain a polyurethane surface layer; adhering the pretreated base fabric to the polyurethane surface layer, drying, and then stripping the release paper to obtain a base fabric containing a polyurethane layer;

chloridizing the base fabric containing the polyurethane layer to obtain the renewable antibacterial waterborne polyurethane synthetic leather with the high peel strength;

wherein a preparation method of the renewable and durable antibacterial waterborne polyurethane emulsion comprises the following steps:

(1) mixing polymer diol and diisocyanate for a first reaction to obtain a first mixture;

(2) mixing the first mixture, dibutyltin dilaurate, and N,N-dimethylformamide for a second reaction to obtain a second mixture;

(3) mixing the second mixture, a chain extender, an epoxy resin, and N,N-dimethylformamide for a third reaction to obtain a third mixture;

(4) mixing the third mixture, a halamine antibacterial monomer, an ultraviolet absorbent, and N,N-dimethylformamide for a fourth reaction to obtain a fourth mixture;

(5) mixing the fourth mixture, an antioxidant, triethylamine, and N,N-dimethylformamide for a neutralization reaction to obtain a fifth mixture;

(6) adjusting a viscosity of the fifth mixture by using N,N-dimethylformamide, and mixing the fifth mixture with water and diethylenetriamine for an emulsification to obtain the renewable and durable antibacterial waterborne polyurethane emulsion;

a mass-to-volume ratio of the polymer diol in the step (1) to the chain extender, the epoxy resin and the N,N-dimethylformamide in the step (3) is (30-40) g:(3-5) g:(5-8) g:(15-20) mL;

the ultraviolet absorbent in the step (4) is 2,4-dihydroxybenzophenone;

a mass-to-volume ratio of the polymer diol in the step (1) to the halamine antibacterial monomer, the ultraviolet absorbent, and the N,N-dimethylformamide in the step (4) is (30-40) g:(1-3) g:(2-5) g:(15-25) mL; and the halamine antibacterial monomer in the step (4) is 3-(2,3-dihydroxypropyl)-5,5-dimethylhydantoin and has a structural formula as follows:

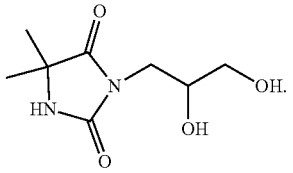

2. The preparation method of the renewable antibacterial waterborne polyurethane synthetic leather with the high peel strength according to claim 1, wherein the base fabric is one of a polyester filament knitted fabric, a polyester filament woven fabric, a polyester staple fiber knitted fabric, a polyester staple fiber woven fabric, a polyester staple fiber spunlace non-woven fabric, and a polyester staple fiber needle-punched non-woven fabric.

3. The preparation method of the renewable antibacterial waterborne polyurethane synthetic leather with the high peel strength according to claim 1, wherein the renewable and durable antibacterial waterborne polyurethane emulsion is coated on the release paper in an amount of 150-200 g/$m^2$.

4. The preparation method of the renewable antibacterial waterborne polyurethane synthetic leather with the high peel strength according to claim 3, wherein the base fabric containing the polyurethane layer is chloridized by performing a second impregnation on the base fabric containing the polyurethane layer in a sodium hypochlorite solution; an available chlorine content of the sodium hypochlorite solution is 3000 ppm; a liquor ratio of the second impregnation is 1:(5-10); and the second impregnation is performed for 20-30 min.

5. The preparation method of the renewable antibacterial waterborne polyurethane synthetic leather with the high peel strength according to claim 1, wherein in the preparation method of the renewable and durable antibacterial waterborne polyurethane emulsion, a mass ratio of the polymer diol and the diisocyanate in the step (1) is (30-40):(15-20);

the first reaction in the step (1) is performed at a temperature of 60-65° C., and the first reaction in the step (1) is performed for 60-90 min;

a mass-to-volume ratio of the polymer diol in the step (1) to the dibutyltin dilaurate and the N,N-dimethylformamide in the step (2) is (30-40) g:(0.1-0.3) g:(10-20) mL;

the second reaction in the step (2) is performed at a temperature of 70-75° C., and the second reaction in the step (2) is performed for 90-120 min; and the third reaction in the step (3) is performed at a temperature of 80-90° C., and the third reaction in the step (3) is performed for 30-45 min.

6. The preparation method of the renewable antibacterial waterborne polyurethane synthetic leather with the high peel strength according to claim 5, wherein in the preparation method of the renewable and durable antibacterial waterborne polyurethane emulsion, the fourth reaction in the step (4) is performed at a temperature of 80-90° C., and the fourth reaction in the step (4) is performed for 60-90 min.

7. The preparation method of the renewable antibacterial waterborne polyurethane synthetic leather with the high peel strength according to claim 6, wherein in the preparation method of the renewable and durable antibacterial waterborne polyurethane emulsion, a mass-to-volume ratio of the polymer diol in the step (1) to the antioxidant, the triethylamine, and the N,N-dimethylformamide in the step (5) is (30-40) g:(0.01-0.1) g:(3-5) g:(5-15) mL;

the neutralization reaction in the step (5) is performed at a temperature of 50-60° C., and the neutralization reaction in the step (5) is performed for 30-60 min.

8. The preparation method of the renewable antibacterial waterborne polyurethane synthetic leather with the high peel strength according to claim 1, wherein in the preparation method of the renewable and durable antibacterial waterborne polyurethane emulsion, the viscosity in the step (6) is 7000-8000 Pa/s;

a mass-to-volume ratio of the polymer diol in the step (1) to the water and the diethylenetriamine in the step (6) is (30-40) g:(200-300) mL:(0.5-1) mL;

the emulsification in the step (6) is performed at a temperature of 25-30° C.; and the emulsification in the step (6) is performed for 60-90 min.

9. A renewable antibacterial waterborne polyurethane synthetic leather with a high peel strength prepared by the preparation method of the renewable antibacterial waterborne polyurethane synthetic leather with the high peel strength according to claim 1.

10. The preparation method of the renewable antibacterial waterborne polyurethane synthetic leather with the high peel strength according to claim 2, wherein in the preparation method of the renewable and durable antibacterial waterborne polyurethane emulsion, a mass ratio of the polymer diol and the diisocyanate in the step (1) is (30-40):(15-20);

the first reaction in the step (1) is performed at a temperature of 60-65° C., and the first reaction in the step (1) is performed for 60-90 min;

a mass-to-volume ratio of the polymer diol in the step (1) to the dibutyltin dilaurate, and the N,N-dimethylformamide in the step (2) is (30-40) g:(0.1-0.3) g:(10-20) mL;

the second reaction in the step (2) is performed at a temperature of 70-75° C., and the second reaction in the step (2) is performed for 90-120 min; and the third reaction in the step (3) is performed at a temperature of 80-90° C., and the third reaction in the step (3) is performed for 30-45 min.

11. The preparation method of the renewable antibacterial waterborne polyurethane synthetic leather with the high peel strength according to claim 7, wherein in the preparation method of the renewable and durable antibacterial waterborne polyurethane emulsion, the viscosity in the step (6) is 7000-8000 Pa/s;

a mass-to-volume ratio of the polymer diol in the step (1) to the water and the diethylenetriamine in the step (6) is (30-40) g:(200-300) mL:(0.5-1) mL;

the emulsification in the step (6) is performed at a temperature of 25-30° C.; and the emulsification in the step (6) is performed for 60-90 min.

12. The renewable antibacterial waterborne polyurethane synthetic leather with the high peel strength according to claim 9, wherein in the preparation method of the renewable antibacterial waterborne polyurethane synthetic leather with the high peel strength, the base fabric is one of a polyester filament knitted fabric, a polyester filament woven fabric, a polyester staple fiber knitted fabric, a polyester staple fiber woven fabric, a polyester staple fiber spunlace non-woven fabric, and a polyester staple fiber needle-punched non-woven fabric.

13. The renewable antibacterial waterborne polyurethane synthetic leather with the high peel strength according to claim 9, wherein in the preparation method of the renewable antibacterial waterborne polyurethane synthetic leather with the high peel strength, the renewable and durable antibacterial waterborne polyurethane emulsion is coated on the release paper in an amount of 150-200 g/m$^2$.

14. The renewable antibacterial waterborne polyurethane synthetic leather with the high peel strength according to claim 13, wherein in the preparation method of the renewable antibacterial waterborne polyurethane synthetic leather with the high peel strength, the base fabric containing the polyurethane layer is chloridized by performing a second impregnation on the base fabric containing the polyurethane layer in a sodium hypochlorite solution; an available chlorine content of the sodium hypochlorite solution is 3000 ppm; a liquor ratio of the second impregnation is 1:(5-10); and the second impregnation is performed for 20-30 min.

15. The renewable antibacterial waterborne polyurethane synthetic leather with the high peel strength according to claim 9, wherein in the preparation method of the renewable and durable antibacterial waterborne polyurethane emulsion, a mass ratio of the polymer diol and the diisocyanate in the step (1) is (30-40):(15-20);

the first reaction in the step (1) is performed at a temperature of 60-65° C., and the first reaction in the step (1) is performed for 60-90 min;

a mass-to-volume ratio of the polymer diol in the step (1) to the dibutyltin dilaurate, and the N,N-dimethylformamide in the step (2) is (30-40) g:(0.1-0.3) g:(10-20) mL;

the second reaction in the step (2) is performed at a temperature of 70-75° C., and the second reaction in the step (2) is performed for 90-120 min; and the third reaction in the step (3) is performed at a temperature of 80-90° C., and the third reaction in the step (3) is performed for 30-45 min.

16. The renewable antibacterial waterborne polyurethane synthetic leather with the high peel strength according to claim 15, wherein in the preparation method of the renewable and durable antibacterial waterborne polyurethane emulsion, the fourth reaction in the step (4) is performed at a temperature of 80-90° C., and the fourth reaction in the step (4) is performed for 60-90 min.

17. The renewable antibacterial waterborne polyurethane synthetic leather with the high peel strength according to claim 16, wherein in the preparation method of the renewable and durable antibacterial waterborne polyurethane emulsion, a mass-to-volume ratio of the polymer diol in the step (1) to the antioxidant, the triethylamine, and the N,N-dimethylformamide in the step (5) is (30-40) g:(0.01-0.1) g:(3-5) g:(5-15) mL;

the neutralization reaction in the step (5) is performed at a temperature of 50-60° C., and the neutralization reaction in the step (5) is performed for 30-60 min.

18. The renewable antibacterial waterborne polyurethane synthetic leather with the high peel strength according to claim 9, wherein in the preparation method of the renewable and durable antibacterial waterborne polyurethane emulsion, the viscosity in the step (6) is 7000-8000 Pa/s;

a mass-to-volume ratio of the polymer diol in the step (1) to the water and the diethylenetriamine in the step (6) is (30-40) g:(200-300) mL:(0.5-1) mL;

the emulsification in the step (6) is performed at a temperature of 25-30° C.; and the emulsification in the step (6) is performed for 60-90 min.

* * * * *